US009291981B2

(12) United States Patent
Nakamura

(10) Patent No.: US 9,291,981 B2
(45) Date of Patent: Mar. 22, 2016

(54) ELECTROPHOTOGRAPHIC PHOTORECEPTOR AND IMAGE FORMING APPARATUS INCLUDING THE SAME

(71) Applicant: KYOCERA Corporation, Kyoto-shi, Kyoto (JP)

(72) Inventor: Takashi Nakamura, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 64 days.

(21) Appl. No.: 14/347,969

(22) PCT Filed: Sep. 27, 2012

(86) PCT No.: PCT/JP2012/074892
§ 371 (c)(1),
(2) Date: Mar. 27, 2014

(87) PCT Pub. No.: WO2013/047662
PCT Pub. Date: Apr. 4, 2013

(65) Prior Publication Data

US 2014/0242508 A1 Aug. 28, 2014

(30) Foreign Application Priority Data

Sep. 30, 2011 (JP) ..... 2011-215919

(51) Int. Cl.

| | |
|---|---|
| ***G03G 5/00*** | (2006.01) |
| ***G03G 15/00*** | (2006.01) |
| ***G03G 5/14*** | (2006.01) |
| ***G03G 5/082*** | (2006.01) |
| ***G03G 5/147*** | (2006.01) |

(52) U.S. Cl.
CPC ..... *G03G 15/751* (2013.01); *G03G 5/08221* (2013.01); *G03G 5/08235* (2013.01); *G03G 5/08278* (2013.01); *G03G 5/08285* (2013.01); *G03G 5/142* (2013.01); *G03G 5/144* (2013.01); *G03G 5/14704* (2013.01)

(58) Field of Classification Search
CPC ..... G03G 5/142; G03G 5/144
USPC ..... 430/64, 65
See application file for complete search history.

(56) References Cited

U.S. PATENT DOCUMENTS

| | | | |
|---|---|---|---|
| 2009/0324288 | A1 | 12/2009 | Ishii et al. |
| 2010/0260517 | A1 | 10/2010 | Ishii |

FOREIGN PATENT DOCUMENTS

| | | | |
|---|---|---|---|
| JP | 7-120952 | A | 5/1995 |
| JP | 9-204056 | A | 8/1997 |
| JP | 2003-215826 | A | 7/2003 |
| JP | 2009-288804 | A | 12/2009 |
| JP | 2010-008553 | A | 1/2010 |
| JP | 2010-008653 | A | 1/2010 |
| WO | 2009-028448 | A1 | 3/2009 |

OTHER PUBLICATIONS

International Search Report, PCT/JP2012/074892, Nov. 16, 2012, 2 pgs.

*Primary Examiner* — Mark A Chapman
(74) *Attorney, Agent, or Firm* — Volpe and Koenig, P.C.

(57) ABSTRACT

An electrophotographic photoreceptor includes a cylindrical base and a photosensitive layer disposed on the cylindrical base. The photosensitive layer has a photoconductive layer disposed on the cylindrical base, a charge injection blocking layer disposed on the photoconductive layer, and a surface layer disposed on the charge injection blocking layer. The charge injection blocking layer contains at least one of nitrogen and oxygen, carbon, and a group 13 element. A content of the at least one of nitrogen and oxygen contained in the charge injection blocking layer is lower on a side of the surface layer than on a side of the photosensitive layer.

6 Claims, 4 Drawing Sheets

ELECTROPHOTOGRAPHIC PHOTORECEPTOR AND IMAGE FORMING APPARATUS INCLUDING THE SAME

FIELD OF INVENTION

The present invention relates to an electrophotographic photoreceptor and an image forming apparatus including the same.

BACKGROUND

In an image forming apparatus applying an electrophotographic system, an electrophotographic photoreceptor having deposition layers including a photosensitive layer is mounted on an outer peripheral surface of a cylindrical base formed of, for example, aluminum. As such electrophotographic photoreceptor, there are a positive-charge electrophotographic photoreceptor in which surface charges are positive and a negative-charge electrophotographic photoreceptor in which surface charges are negative. Normally, the positive-charge electrophotographic photoreceptor is configured by forming deposition layers including a charge injection blocking layer, a photoconductive layer and a surface layer in this order on the cylindrical base, and the negative-charge electrophotographic photoreceptor is configured by forming deposition layers including the photoconductive layer, the charge injection blocking layer and the surface layer in this order on the cylindrical base. That is, in the negative-charge electrophotographic photoreceptor, the charge injection blocking layer exists on the photoconductive layer, which differs from the positive-charge electrophotographic photoreceptor. Examples of such a negative-charge electrophotographic photoreceptor include a photoreceptor disclosed in Japanese unexamined Patent Publication JP-A 7-120952 (1995).

However, there is a problem that image characteristics, particularly the image contrast is reduced though an electrostatic property is improved.

The invention has been made in view of the above problems, and an object thereof is to provide a negative-charge electrophotographic photoreceptor capable of maintaining the image characteristics to be relatively higher while improving the electrostatic property.

SUMMARY

An electrophotographic photoreceptor according to an embodiment of the invention comprises a cylindrical base and a photosensitive layer disposed on the cylindrical base, wherein the photosensitive layer comprises a photoconductive layer disposed on the cylindrical base, a charge injection blocking layer disposed on the photoconductive layer, and a surface layer disposed on the charge injection blocking layer, the charge injection blocking layer contains at least one of nitrogen and oxygen, carbon, and a group 13 element, and a content of the at least one of nitrogen and oxygen contained in the charge injection blocking layer is lower on a side of the surface layer than on a side of the photosensitive layer.

BRIEF DESCRIPTION OF THE DRAWING(S)

DETAILED DESCRIPTION OF THE PREFERRED EMBODIMENTS

Figure 1:
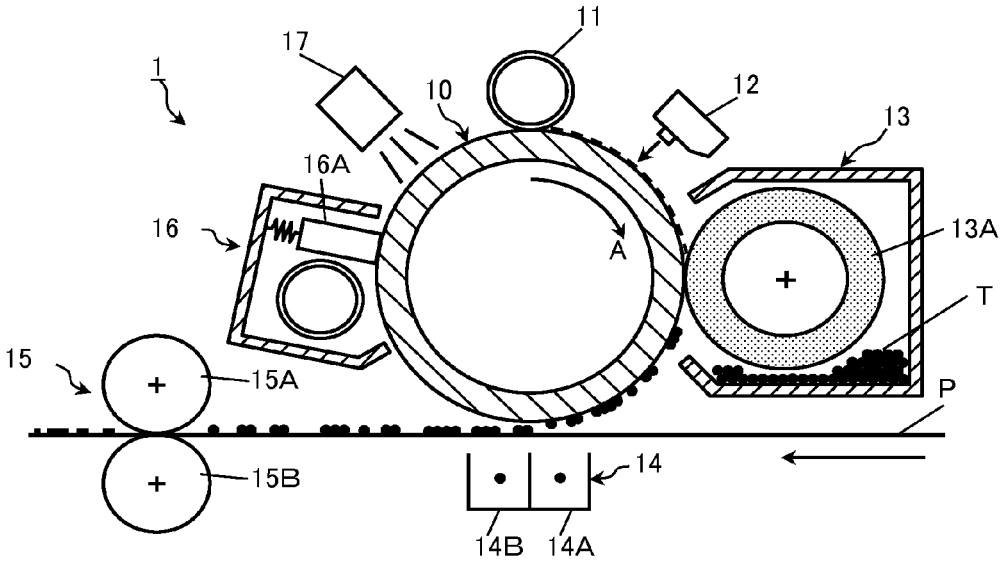
FIG. 1 is a cross-sectional view showing a schematic structure of an image forming apparatus according to an embodiment of the invention.

FIG. 1 is a view showing a schematic structure of an image forming apparatus 1 according to the invention. The image forming apparatus 1 applies the Carlson process as an image forming method, and includes a negative-charge electrophotographic photoreceptor (hereinafter referred to as a "negatively-charged drum") 10, a charging device 11, an exposure device 12, a developing device 13, a transfer device 14, a fixing device 15, a cleaning device 16 and a charge removing device 17.

The charging device 11 is configured to charge a surface of the negatively-charged drum 10 to a negative polarity (for example, 200 V or more and 1000 V or less). The charging device 11 is disposed so as to closely press the negatively-charged drum 10, which is obtained by covering a metal core with a conductive rubber and PVDF (polyvinylidene fluoride). As the charging device 11, a non-contact type charging device including a discharge wire may be used instead of a roller-shaped contact type charging device as in the embodiment.

The exposure device 12 is configured to form an electrostatic latent image on the negatively-charged drum 10, which can emit light having a specific wavelength (for example, 650 nm or more and 780 nm or less). According to the exposure device 12, the surface of the negatively-charged drum 10 is irradiated with light corresponding to an image signal to attenuate a potential of the light irradiated portion, thereby forming the electrostatic latent image as the potential contrast. As the exposure device 12, for example, an LED head in which a plurality of LED elements capable of emitting light having a wavelength of 680 nm are arranged can be used.

Naturally, as a light source of the exposure device 12, a light source which can emit laser light can be used instead of the LED devices. Namely, an optical system composed of a laser beam, a polygon mirror and so on or an optical system composed of a lens, a mirror and so on in which reflected light from a document travels is used instead of the exposure device 12 such as the LED head, thereby forming an image forming apparatus having a structure of a copying machine.

The developing device 13 is configured to develop the electrostatic latent image of the negatively-charged drum 10 to form a toner image. The developing device 13 has a magnetic roller 13A magnetically holding a developer (toner).

The developer constitutes the toner image formed on the surface of the negatively-charged drum 10, which can be frictionally charged in the developing device 13. As the developer, a two-component developer including a magnetic carrier and an insulating toner or a one-component developer including a magnetic toner can be used.

The magnetic roller 13A has a function of feeding the developer onto the surface (development area) of the negatively-charged drum 10.

In the developing device 13, the frictionally-charged toner is fed as a form of a magnetic brush which has been adjusted to a fixed ear length by the magnetic roller 13A, and the toner is attached to the surface of the photoreceptor by electrostatic attraction with respect to the electrostatic latent image to be visualized in the development area of the negatively-charged drum 10. When the image is formed by the normal development, the charging polarity of the toner image is a reverse polarity to the charging polarity on the surface of the negatively-charged drum 10. When the image is formed by the reversal development, the charging polarity of the toner image is the same polarity as the charging polarity on the surface of the negatively-charged drum 10.

Though the developing device 13 applies a dry development system in the embodiment, a wet development system using a liquid developer can be applied.

The transfer device 14 is configured to transfer the toner image of the negatively-charged drum 10 to a recording medium P supplied to a transfer area between the negatively-charged drum 10 and the transfer device 14. The transfer device 14 includes a transfer charger 14A and a separation charger 14B. In the transfer device 14, a back surface (non-recording surface) of the recording medium P is charged to be the reverse polarity to the toner image in the transfer charger 14A, and the toner image is transferred on the recording medium P by the electrostatic attraction between electrostatic charges and the toner image. Further, in the transfer device 14, the back surface of the recording medium P is AC-charged in the separation charger 14B at the same time as the transfer of the toner image, and the recording medium P is immediately separated from the surface of the negatively-charged drum 10.

As the transfer device 14, it is also possible to use a transfer roller which moves in accordance with the rotation of the negatively-charged drum 10 and disposed at a minute gap (normally 0.5 mm or less) with respect to the negatively-charged drum 10. The transfer roller used in this case is configured to apply a transfer voltage so as to attract the toner image on the negatively-charged drum 10 onto the recording medium P by, for example, a DC power supply. When using the transfer roller, the transfer separation device such as the separation charger 14B can be omitted.

The fixing device 15 is configured to fix the toner image transferred to the recording medium P onto the recording medium P, and including a pair of fixing rollers 15A and 15B. The fixing rollers 15A and 15B are formed, for example, by coating the surface of metal rollers with Teflon (trademark) or the like. In the fixing device 15, the recording medium P is allowed to pass between the pair of fixing rollers 15A and 15B, thereby fixing the toner image on the recording medium P by application of heat, pressure and the like.

The cleaning device 16 is configured to remove the toner remaining on the surface of the negatively-charged drum 10, and includes a cleaning blade 16A. The cleaning blade 16A has a function of scraping the residual toner from the surface of the negatively-charged drum 10. The cleaning blade 16A is formed of, for example, a rubber material mainly containing polyurethane resin.

The charge removing device 17 is configured to removing the surface charges on the negatively-charged drum 10, which can emit light having a specific wavelength (for example, 780 nm or more). The charge removing device 17 is configured to remove surface charges (residual static latent image) on the negatively-charged drum 10 by irradiating the entire surface of the negatively-charged drum 10 with light by using a light source such as LED devices.

Figure 2:
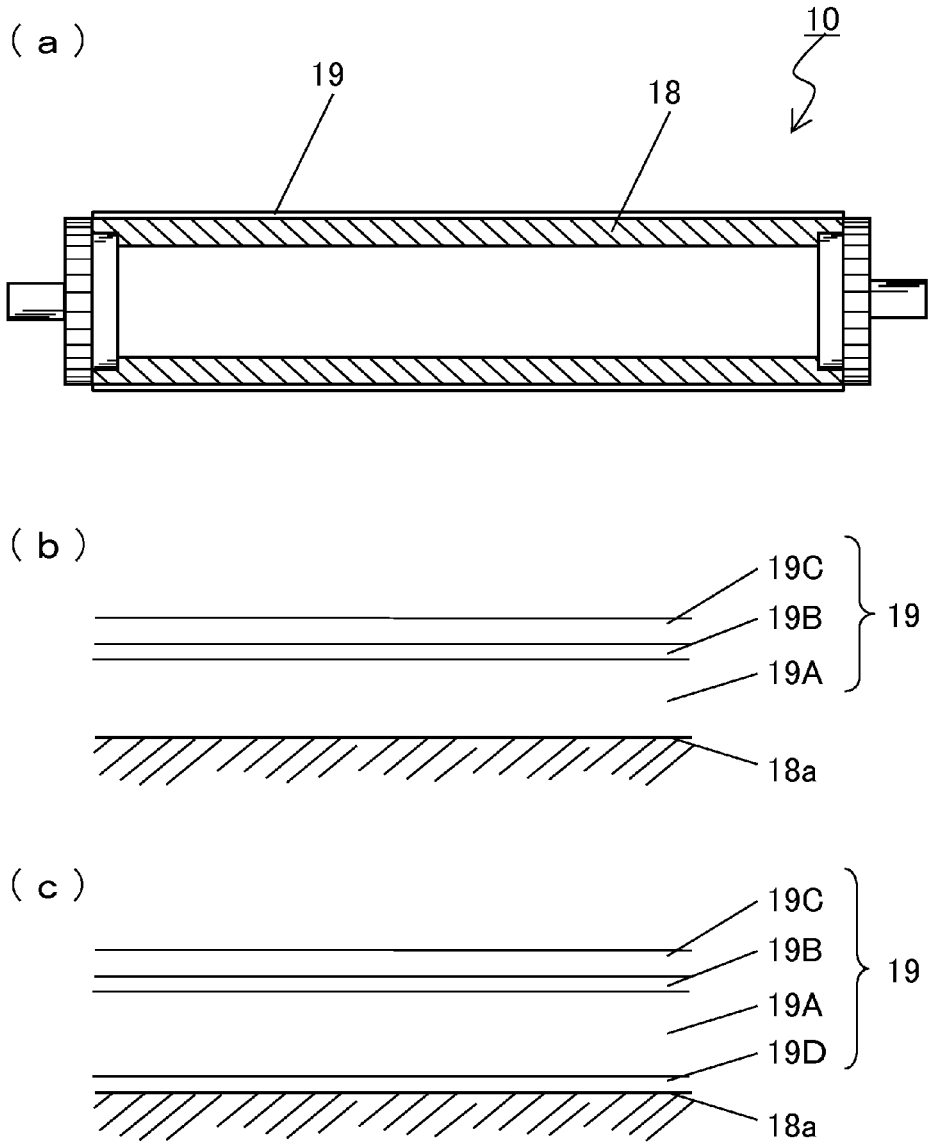
FIG. 2(*a*) is a cross-sectional view of an electrophotographic photoreceptor according to the embodiment of the invention, FIG. 2(*b*) is an enlarged view of a main part of FIG. 2(*a*), and FIG. 2(*c*) is an enlarged view of a main part of an electrophotographic photoreceptor according to another embodiment of the invention.

FIG. 2(*a*) is a cross-sectional view showing a schematic structure of the negatively-charged drum 10. The negatively-charged drum 10 has a cylindrical base 18 and a photosensitive layer 19, in which the electrostatic latent image or the toner image is formed based on the image signal. The negatively-charged drum 10 is rotatable in a direction of an arrow A in FIG. 1 by a rotation mechanism (not shown).

The cylindrical base 18 is a support base member of the negatively-charged drum 10, and is configured to have a conductive property at least on the surface thereof. The cylindrical base 18 is formed of metal materials such as aluminum (Al), stainless steel (SUS), zinc (Zn), copper (Cu), iron (Fe), titanium (Ti), nickel (Ni), chrome (Cr), tantalum (Ta), tin (Sn), gold (Au) and silver (Ag), or alloy materials including the above-exemplified metal materials so that the entire base has the conductive property. As the material constituting the cylindrical base 18, Al alloy materials (for example, Al—Mn based alloys, Al—Mg based alloys and Al—Mg—Si based alloys) are particularly preferable among the above materials with the objective of increasing the adhesion with respect to the photosensitive layer 19 in the case where the photosensitive layer 19 is formed by using an amorphous silicon based (a-Si based) material. The cylindrical base 18 may be obtained by forming a conductive film formed of the above-exemplified metal materials or a transparent conductive material such as ITO (Indium Tin Oxide) and SnO2 on the surface of an insulating material such as resin, glass or ceramics.

The photosensitive layer 19 is formed on an outer peripheral surface 18*a* of the cylindrical base 18, and the thickness thereof is set to, for example, 15 μm or more and 100 μm or less. When the thickness of the photosensitive layer 19 is set to 15 μm or more, for example, the occurrence of interference fringes on a recording image can be suitably suppressed even without a long-wavelength light absorbing layer, and when the thickness of the photosensitive layer 19 is set to 90 μm or less, the peel-off of the photosensitive layer 19 can be suitably suppressed due to the stress.

Referring to FIG. 2(*b*), in the embodiment, the photosensitive layer 19 is formed by stacking a photoconductive layer 19A, a charge injection blocking layer 19B and a surface layer 19C.

The photoconductive layer 19A is configured to generate carriers by light irradiation such as laser light, and the thickness thereof is set to, for example, 12.5 μm or more and 100 μm or less (preferably 10 μm or more and 80 μm or less) from the viewpoint of electrophotographic characteristics. Examples of a material constituting the photoconductive layer 19A include a-Si based materials such as a-Si, a-SiC, a-SiN, a-SiO, a-SiGe, a-SiCN, a-SiNO, a-SiCO and a-SiCNO, and particularly, among them, a-Si or a-Si based alloy materials in which an element such as C, N or O is added to a-Si is preferable from the viewpoint of stable acquisition of excellent electrophotographic characteristics (optical sensitivity characteristics, high-speed response, repeating stability, heat resistance, durability and so on) or from the viewpoint of consistency with respect to the surface layer 19C in the case where the surface layer 19C is formed of a-SiC (particularly, hydrogenated amorphous silicon carbide (a-SiC:H).

The photoconductive layer 19A can be formed by, when the entire layer is formed as an inorganic substance, film-forming methods such as a glow discharge decomposition method, various sputtering methods, various vapor deposition methods, an ECR (Electron Cyclotron Resonance) method, a photo-CVD method, a Cat-CVD method and a reaction vapor deposition method.

The charge injection blocking layer 19B is configured to block the injection of charges electrified on the surface of the photosensitive layer 19 by the charging device 11 to the side of the photosensitive layer 19A, and the thickness thereof is set to, for example, 0.1 μm or more and 1.0 μm or less. As the charge injection blocking layer 19B, various types of layers can be used according to the material of the photoconductive layer 19A, and it is preferable to use inorganic materials in a-Si based materials even in the charge injection blocking layer 19B with the objective of improving adhesion with respect to the photoconductive layer 19A.

When the a-Si based charge injection blocking layer 19B is provided, the conductive type is adjusted by containing more Group 13 elements in the charge injection blocking layer as compared with the a-Si based photosensitive layer 19A. Moreover, at least one of nitrogen (N) and oxygen (O) is contained to increase the resistance, namely, to reduce the conductivity, thereby improving the electrostatic property of the negatively-charged drum 10. However, when at least one of nitrogen (N) and oxygen (O) is contained, experience shows that image characteristics, particularly, the image contrast will be reduced though the electrostatic property is improved. As a mechanism of reducing image characteristics, it is considered that, when nitrogen (N) or oxygen (O) with relatively low moisture resistance is contained, Si as the main component of the photosensitive layer 19 is easily oxidized, and the oxidized Si easily adsorbs moisture, and therefore, the toner adsorbed in the photosensitive layer 19 spreads in the direction closer to the surface of the photosensitive layer 19 than a desired position.

Accordingly, nitrogen (N) or oxygen (O) contained in the charge injection blocking layer 19B is adjusted to be reduced in the side of the surface layer 19C as compared with the side of the photoconductive layer 19A.

According to such constitution, the negatively-charged drum 10 capable of maintaining image characteristics to be relatively high while improving the electrostatic property.

Such charge injection blocking layer 19B can be formed by, when the entire layer is formed as an inorganic substance, well-known film-forming methods such as the glow discharge decomposition method, various sputtering methods, various vapor deposition methods, the ECR (Electron Cyclotron Resonance) method, the photo-CVD method, the Cat-CVD method and the reaction vapor deposition method.

The surface layer 19C is configured to protect the surface of the negatively-charged drum 10, which is formed of, for example, a-Si based materials such as a-SiC or a-SiN so as to withstand scrapes due to sliding friction inside the image forming apparatus 1. The thickness of the surface layer 19C is set to, for example, 0.2 μm or more and 1.5 μm or less (preferably, 0.5 μm or more and 1.0 μm or less). This is because, when the thickness of the surface layer 19C is set to 0.2 μm or more, the occurrence of image scratches and image concentration unevenness due to plate durability can be sufficiently prevented, and when the thickness of the surface layer 19C is set to 1.5 μm or less, the occurrence of image defects due to residual potentials can be suitably suppressed.

It is preferable that the surface layer 19C is formed by using a-SiC:H in which hydrogen is contained in a-SiC. In a-SiC:H, when the element ratio is represented by a composition formula "a-Si1-XCX:H", X-value is, for example, 0.55 or more and lower than 0.93. When the X-value is set to a range of 0.55 or more and lower than 0.93 (preferably 0.6 or more to 0.7 or less), the surface layer 19C can obtain suitable hardness, and therefore, it is possible to secure the durability of the surface layer 19C, namely, the negatively-charged drum 10. When the surface layer 19C is formed by using a-SiC:H, the H content is preferably set to approximately 1 atom % or more and 70 atom % or less (preferably 45 atom % or less). The above range is preferable in that Si—H coupling is lower than Si—C coupling and charge trapping occurring when the surface of the surface layer 19C is irradiated with light can be suppressed to thereby prevent residual potentials.

The surface layer 19C formed of a-SiC:H can be formed by, when the entire layer is formed as an inorganic substance, well-known film-forming methods such as the glow discharge decomposition method, various sputtering methods, various vapor deposition methods, the ECR (Electron Cyclotron Resonance) method, the photo-CVD method, the Cat-CVD method and the reaction vapor deposition method in the same manner as the case where the photosensitive layer 19A is formed of the a-Si based material.

As shown in FIG. 2(*c*), the photosensitive layer 19 may further include a charge injection blocking layer 19D formed between the cylindrical base 18 and the photoconductive layer 19A.

The charge injection blocking layer 19D is configured to block the injection of carriers from the cylindrical base 18 to the side of the photoconductive layer 19B, which is formed of, for example, the a-Si based material. The charge injection blocking layer 19D is formed by containing phosphorus (P), nitrogen (N) or oxygen (O) as a dopant in a-Si, and the thickness thereof is set to, for example, 2 μm or more and 10 μm or less.

Figure 3:
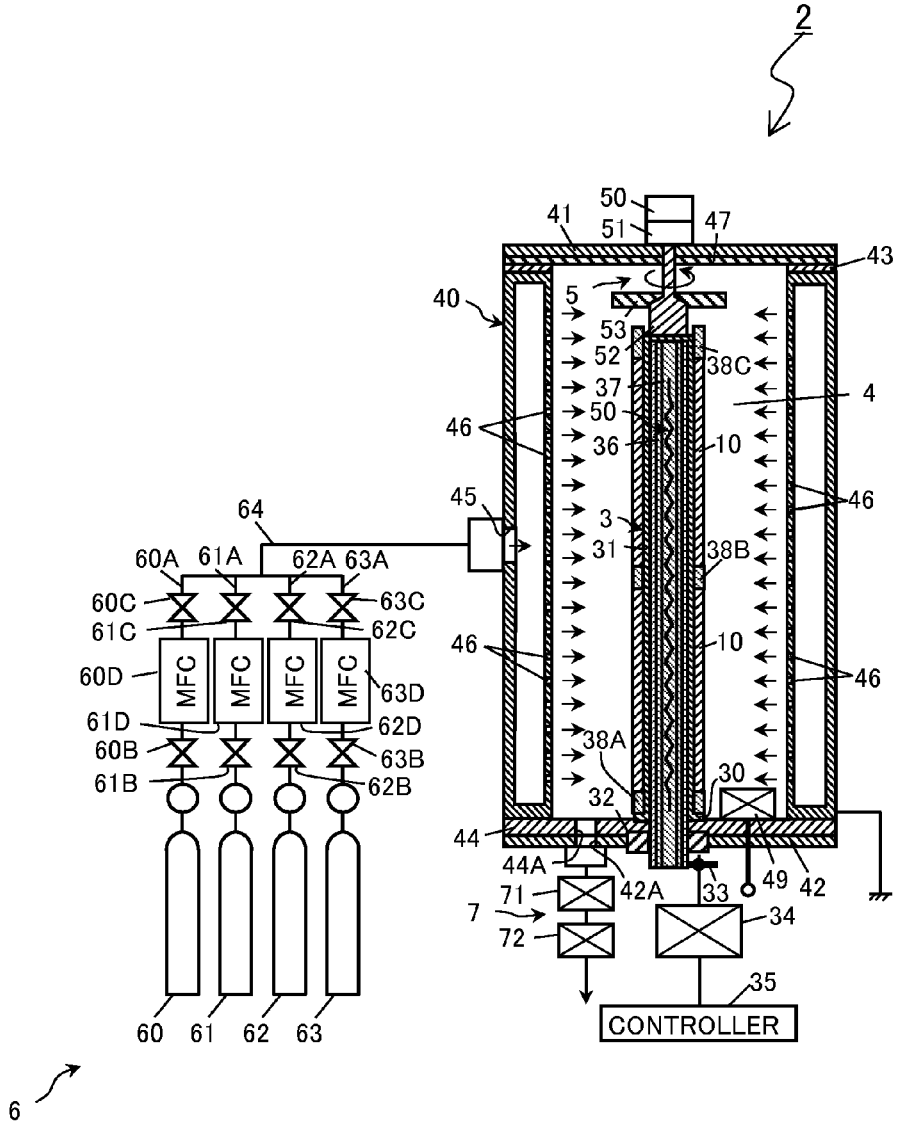
FIG. 3 is a cross-sectional view showing an example of a plasma CVD apparatus for forming a photosensitive layer of the electrophotographic photoreceptor shown in FIG. 2.

The photoconductive layer 19A, the charge injection blocking layer 19B and the surface layer 19C in the negatively-charged drum 10 can be formed by using a plasma CVD apparatus 2, for example, shown in FIG. 3.

The plasma CVD apparatus 2 is configured by housing a support base 3 in a reaction chamber 4, and further includes rotation means 5, gas supply means 6 and exhaust means 7.

The support base 3 is configured to support the cylindrical base 18 as well as functions as a first conductor. The support base 3 is formed in a hollow shape having a flange portion 30 as well as formed as the conductor as a whole by using a conductive material similar to the cylindrical base 18. The support base 3 has a length capable of supporting two cylindrical bases 18, and is detachable from a conductive column 31. Accordingly, the two cylindrical bases 18 in the support base 3 can be taken in and out of the reaction chamber 4 without directly touching the surface of the supported two cylindrical bases 18.

The conductive column 31 is formed as the conductor as a whole by using a conductive material similar to the cylindrical base 18, and is fixed to a plate 42 described later through an insulating material 32 in the center of the reaction chamber 4. A DC power supply 34 is connected to the conductive column 31 via a conductive plate 33. The operation of the DC power supply 34 is controlled by a controller 35. The controller 35 is configured to supply a pulse-shaped DC voltage (refer to FIG. 4) to the support base 3 through the conductive column 31 by controlling the DC power supply 34.

A heater 37 is housed inside the conductive column 31 through a ceramic pipe 36. The ceramic pipe 36 is configured to secure insulation performance and thermal conductivity. The heater 37 is configured to heat the cylindrical base 18. As the heater 37, for example, a nichrome wire or a cartridge heater can be used.

Here, the temperature of the support base 3 is monitored by a thermocouple (not shown) installed in, for example, the support base 3 or the conductive column 31, and the heater 37 is turned on/off based on monitoring results in the thermocouple, thereby maintaining the temperature of the cylindrical base 18 within a fixed range selected from a given range (for example, 200° C. or higher and 400° C. or lower).

The reaction chamber 4 is a space for forming a deposited film on the cylindrical base 18, and is configured by a cylindrical electrode 40 and a pair of plates 41 and 42.

The cylindrical electrode 40 functions as a second conductor, and is formed in a substantially cylindrical shape so as to surround the support base 3. The cylindrical electrode 40 is formed in a hollow shape by using a conductive material similar to the cylindrical base 18, and is bonded to the pair of plates 41 and 42 via insulating members 43 and 44. Note that the cylindrical electrode 40 is formed so that the distance between the cylindrical base 18 and the cylindrical electrode 40 is 10 mm or more and 100 mm or less. This is because, when the distance between the cylindrical base 18 and the cylindrical electrode 40 is less than 10 mm, it is difficult to obtain stable discharge between the cylindrical base 18 and the cylindrical electrode 40, and, when the distance between the cylindrical base 18 and the cylindrical electrode 40 is more than 100 mm, the size of the plasma CVD apparatus 2 is increased more than necessary and the productivity per a unit installation area is unreasonably reduced.

The cylindrical electrode 40 includes a gas introducing port 45 and plural gas blow-off holes 46, and is grounded at one end thereof. The cylindrical electrode 40 is not always necessarily grounded and may be connected to a reference power supply different from the DC power supply 34. When the cylindrical electrode 40 is connected to the reference power supply different from the DC power supply 34, a reference voltage in the reference power supply is, for example, 1500 V or more and 1500 V or less.

The gas introducing port 45 is configured to introduce a cleaning gas or a source gas to be supplied to the reaction chamber 4, and is connected to the gas supply means 6.

The plural gas blow-off holes 46 are configured to blow off the cleaning gas or the source gas introduced into the cylindrical electrode 40 toward the cylindrical base 18, and are disposed in the vertical direction of the drawing at equal intervals as well as in the circumference direction at equal intervals. The plural gas blow-off holes 46 are formed in circles having the same shape, and a hole diameter thereof is, for example, 0.5 mm or more and 2.0 mm or less. The hole diameter, the shape and the arrangement of the plural gas blow-off holes 46 can be appropriately changed.

The plate 41 is configured to allow an opened state or a closed state of the reaction chamber 4 to be selectable, and the support base 3 can be taken in and out of the reaction chamber 4 by opening and closing the plate 41. The plate 41 is formed of a conductive material similar to the cylindrical base 18, and an adhesion prevention plate 47 is attached on the undersurface side of the plate 41. Accordingly, the formation of the deposited film on the plate 41 is prevented. The adhesion prevention plate 47 is also formed of a conductive material similar to the cylindrical base 18, and the adhesion prevention plate 47 is configured to be detachable from the plate 41.

The plate 42 functions as a base of the reaction chamber 4, which is formed of a conductive material similar to the cylindrical base 18. The insulating member 44 interposed between the plate 42 and the cylindrical electrode 40 has a function of suppressing the occurrence of arc discharge between the cylindrical electrode 40 and the plate 42. Such an insulating member 44 can be formed of, for example, glass materials (borosilicate glass, soda glass, heat-resistant glass and so on), inorganic insulating materials (ceramics, quartz and sapphire and the like), or synthetic-resin insulating materials (fluorocarbon resin such as Teflon (trademark), polycarbonate, polyethylene terephthalate, polyester, polyethylene, polypropylene, polystyrene, polyamide, vinylon, epoxy, Mylar, PEEK material and so on), however, materials are not particularly limited as long as the material has insulation performance and sufficient heat resistance in use temperature, in which gas discharge in vacuum is small. However, the insulating member 44 has a thickness of a certain degree or more for preventing unavailability due to the occurrence of curvature by a stress caused by the bimetallic effect generated in accordance with an internal stress of a film-formed body and the temperature increase at the time of forming the film. For example, when the insulating member 44 is formed of a material having a thermal expansion coefficient of 3×10−5/K or more and 10×105/K or less such as Teflon (trademark), the thickness of the insulating member 44 is set to 10 mm or more. In the case where the thickness of the insulating member 44 is set in the above range, an amount of curvature caused by the stress generated at an interface between the insulating member 44 and the a-Si film which is deposited on the cylindrical base 18 and has a thickness of 10 μm or more and 30 μm or less, can be 1 mm or less as the difference of heights in an axial direction between at an end portion and a central portion in the horizontal direction with respect to a length of 200 mm in the horizontal direction (radial direction approximately orthogonal to the axial direction of the cylindrical base 18), which enables the insulating member 44 to be repeatedly used.

Gas exhaust ports 42A and 44A and a pressure gauge 49 are disposed in the plate 42 and the insulating member 44. The exhaust ports 42A and 44A are configured to exhaust gas inside the reaction chamber 4, and is connected to the exhaust means 7. The pressure gauge 49 is configured to monitor the pressure of the reaction chamber 4, and well-known various types of pressure gauges can be used.

The rotation means 5 is configured to rotate the support base 3, and includes a rotation motor 50, a rotation introducing terminal 51 and an insulating shaft member 52 and an insulating flat plate 53. When the film is deposited by rotating the support base 3 by the rotation means 5, the cylindrical base 18 is rotated together with the support base 3, and therefore, decomposition components of the source gas can be deposited on the outer periphery of the cylindrical base 18 approximately equally.

The rotation motor 50 is configured to give a rotational force to the cylindrical base 18. The operation of the rotation motor 50 is controlled so as to rotate the cylindrical base 18, for example, at a fixed rotational frequency of 1 rpm or more and 10 rpm or less. As the rotation motor 50, well-known various motors can be used.

The rotation introducing terminal 51 is configured to transmit the rotational force while maintaining a certain vacuum degree of vacuum inside the reaction chamber 4. As such a rotation introducing terminal 51, the rotation shaft having a double or triple structure and a vacuum sealing means such as an oil sealing or a mechanical sealing can be used.

The insulating shaft member 52 and the insulating flat plate 53 are configured to input the rotational force from the rotation motor 50 into the support base 3 while maintaining the insulation state between the support base 3 and the plate 41, and is formed of, for example, an insulating material similar to the insulating member 44 and so on. Here, an outside diameter of the insulating shaft member 52 is set to be smaller than an outside diameter of the support base 3 (an inside diameter of an upper dummy base 38C described later) at the time of forming the film. More specifically, in the case where the temperature of the cylindrical base 18 is set to 200° C. or higher and 400° C. or lower at the time of forming the film, an outside diameter of the insulating shaft member 52 is set to 0.1 mm or more and 5 mm or less, preferably approximately 3 mm larger than the outside diameter of the support base 3 (the inside diameter of the upper dummy base 38C described later). In order to satisfy the above conditions, the difference between the outside diameter of the insulating shaft member 52 and the outside diameter of the support body 3 (the inside diameter of the upper dummy base 38C described later) is set to 0.6 mm or more and 5.5 mm or less in a non-film forming state (under normal temperature environment (for example, 10° C. or higher and 40° C. or lower)).

The insulating flat plate 53 is configured to prevent adhesion of foreign matters such as dust or coarse particulates falling from above at the time of removing the plate 41 to the cylindrical base 18, and is formed in a circular disc shape having a larger outside diameter than the inside diameter of the upper dummy base 38C. The diameter of the insulating flat plate 53 is 1.5 times or more and 3.0 times or less as large as the diameter of the cylindrical base 18, namely, the diameter of the insulating flat plate 53 is approximately 50 mm when using the cylindrical base 18 having a diameter of 30 mm.

When such an insulating flat plate 53 is provided, abnormal discharge caused by foreign matters adhered to the cylindrical base 18 can be suppressed, and therefore, the occurrence of film-forming defects can be suppressed. Accordingly, the yield can be improved at the time of forming the electrophotographic photoreceptor 1, and the occurrence of image defects can be suppressed at the time of forming the image by using the electrophotographic photoreceptor 1.

The gas supply means 6 includes plural source gas tanks 60, 61, 62 and 63, plural pipes 60A, 61A, 62A and 63A, valves 60B, 61B, 62B, 63B, 60C, 61C, 62C and 63C and plural mass flow controllers 60D, 61D, 62D and 63D, and is connected to the cylindrical electrode 40 through a pipe 64 and the gas introducing port 45.

The respective source gas tanks 60 to 63 are filled with the source gases. As source gases, for example, SiH4, H2, B2H6, CH4, N2 and NO are used.

The valves 60B to 63B and 60C to 63C and the mass flow controller 60D to 63D are configured to adjust the flow rate, the composition and the gas pressure of gas components to be introduced into the reaction chamber 4. In the gas supply means 6, types of gases to be filled in the respective source gas tanks 60 to 63 or the number of plural source gas tanks 60 to 63 may be appropriately selected in accordance with the type or the composition of the film to be formed on the cylindrical base 18.

The exhaust means 7 is configured to exhaust the gas in the reaction chamber 4 to the outside through the gas exhaust ports 42A and 44A, and includes a mechanical booster pump 71 and a rotary pump 72. The operation of the pumps 71 and 72 is controlled based on monitoring results by the pressure gauge 49. That is, in the exhaust means 7, a given vacuum state can be maintained in the reaction chamber 4 as well as the gas pressure in the reaction chamber 4 can be set to a target value based on the monitoring results by the pressure gauge 49. The pressure of the reaction chamber 4 is set to, for example, 1.0 Pa or more and 100 Pa or less.

Next, as to a method of forming the deposited film using the plasma CVD apparatus 2, a case where the negatively-charged drum 10 (refer to FIG. 2) in which the a-Si based film is formed on the cylindrical base 18 is fabricated will be explained as an example.

First, after the plate 41 of the plasma CVD apparatus 2 is removed, the support base 3 in which plural (two in the drawing) cylindrical bases 18 are supported is set inside the reaction chamber 4, and the plate 41 is attached again.

When supporting the two cylindrical bases 18 in the support base 3, a lower dummy base 38A, the cylindrical base 18, an intermediate dummy base 38B, the cylindrical base 18 and the upper dummy base 38C are sequentially stacked on the flange portion 30 in a state where a main portion of the support base 3 is mantled.

As respective dummy bases 38A to 38C, the ones in which conductive processing is performed on surfaces of conductive or insulating bases are selected in accordance with applications of products. Normally, the ones formed in a cylindrical shape by using a material similar to the cylindrical base 18 are used.

The lower dummy base 38A is configured to adjust the height position of the cylindrical base 18. The intermediate dummy base 38B is configured to suppress the occurrence of film-forming defects in the cylindrical base 18 caused by arc discharge generated between end portions of adjacent cylindrical bases 18. As the intermediate dummy base 38B, there is used the one having the minimum length (1 cm in the embodiment) or more in which the arc discharge can be prevented and in which corner portions on the surface side are chamfered so that the curvature is 0.5 mm or more by curved surface processing or so that the length in the axial direction and the length in the depth direction of a portion cut by end surface processing are 0.5 mm or more. The upper dummy base 38C is configured to prevent the formation of the deposited film on the support base 3 and suppress the occurrence of film-forming defects caused by the peel-off of the film-formed body which has been deposited once during the film forming. Part of the upper dummy base 38C projects upward from the support base 3.

Subsequently, the cylindrical base 18 is heated and the pressure of the reaction chamber 4 is reduced by the exhaust means 7.

The heating of the cylindrical base 18 is performed by allowing the heater 37 to generate heat by supplying the power to the heater 37 from the outside. The temperature of the cylindrical base 18 is increased to a target temperature by the heating of the heater 37. The temperature of the cylindrical base 18 is selected according to the type and the composition of the film to be formed on the surface thereof. For example, when the a-Si based film is formed, the temperature is set to a range of 250° C. or higher and 300° C. or lower, and is maintained to a substantially constant temperature by turning on/off the heater 37.

On the other hand, the pressure reduction of the reaction chamber 4 is performed by exhausting gas from the vacuum reaction chamber 4 through the gas exhaust ports 42A and 44A by the exhaust means 7. The degree of pressure reduction of the reaction chamber 4 is, for example, approximately 10-3 Pa by controlling the operation of the mechanical booster pump 71 and the rotary pump 72 while monitoring the pressure of the reaction chamber 4 by the pressure gauge 49.

Subsequently, in the case where the temperature of the cylindrical base 18 becomes a desired temperature and the pressure of the reaction chamber 4 becomes a desired pressure, the source gas is supplied into the reaction chamber 4 by the gas supply means 6 as well as the pulse-shaped DC voltage is applied between the cylindrical electrode 40 and the support base 3. Accordingly, glow discharge occurs between the cylindrical electrode 40 and the support base 3 (the cylindrical base 18), the source gas is decomposed, and the decomposition components of the source gas are deposited on the surface of the cylindrical base 18.

Meanwhile, the exhaust means 7 controls the operation of the mechanical booster pump 71 and the rotary pump 72 while monitoring the gas pressure in the reaction chamber 4 by the pressure gauge 49, thereby maintaining a target range of gas pressure in the reaction chamber 4. That is, a stable gas pressure is maintained inside the reaction chamber 4 by the mass flow controllers 60D to 63D in the gas supply means 6 and the pumps 71, 72 in the exhaust means 7. The gas pressure in the reaction chamber 4 is set to, for example, 1.0 Pa or more and 100 Pa or less.

The supply of the source gas to the reaction chamber 4 is performed, through controlling the mass flow controllers 60D to 63D while appropriately controlling open/close states of the valves 60B to 63B and 60C to 63C, by introducing the source gas in the source gas tanks 60 to 63 into the cylindrical electrode 40 through the pipes 60A to 63A, 64 and the gas introducing port 45 with a desired composition and flow rate. The source gas introduced into the cylindrical electrode 40 is blown off toward the cylindrical base 18 through the plural gas blow-off holes 46. Then, the composition of the source gas is appropriately switched by the valves 60B to 63B, 60C to 63C and the mass flow controllers 60D to 63D, thereby sequentially stacking the photoconductive layer 19A, the charge injection blocking layer 19B and the surface layer 19C on the surface of the cylindrical base 18.

For example, when the photoconductive layer 19A is formed as the a-Si based deposited film, a mixed gas including a Si-containing gas such as SiH4 (silane gas) and a dilution gas such as hydrogen (H2) and helium (He) is used as the source gas. In the photoconductive layer 19A, a hydrogen gas may be used as the dilution gas or a halide may be contained in the source gas so that the layer contains 1 atom % or more and 40 atom % or less of hydrogen (H) or halogen elements (F, Cl) for terminating dangling-bond. The source gas may also contain Group 13 elements of the periodic table (hereinafter abbreviated as "Group 13 elements" or Group 15 elements of the periodic table (hereinafter abbreviated as "Group 15 elements") in order to obtain electrical characteristics such as dark conductivity and photoconductivity and desired characteristics concerning the optical bandgap as well as may contain elements such as carbon (C), nitrogen (N) and oxygen (O) in order to adjust the above various characteristic.

When the charge injection blocking layer 19B is formed as the a-Si based deposited film, a mixed gas including a Si-containing gas such as SiH4 (silane gas), a dopant-containing gas such as B2H6 and a dilution gas such as hydrogen (H2) and helium (He) is used as the source gas. As the dopant-containing gas, carbon (C)-, nitrogen (N)- or oxygen (O)-containing gas is used in addition to a boron (B)-containing gas, thereby allowing the charge injection blocking layer 19B to contain carbon (C), nitrogen (N) or oxygen (O). Then, in order to maintaining relatively higher image characteristics while improving the electrostatic property of the photoreceptor drum 10, the amount supplied of the nitrogen (N) or oxygen (O)-containing gas is adjusted so that the nitrogen (N) content or the oxygen (O) content in the charge injection blocking layer 19B is lower on a side of the surface layer 19C than on a side of the photoconductive layer 19A. Specifically, it is possible to supply a certain amount of the nitrogen (N)- or oxygen (O)-containing gas from the beginning of forming the charge injection blocking layer 19B to thereby reduce the amount supplied of the nitrogen (N)- or oxygen (O)-containing gas on the side of the surface layer 19C of the charge injection blocking layer 19B, or the amount of supplied of the nitrogen (N)- or oxygen (O)-containing gas from the beginning of forming the charge injection blocking layer 19B gradually at a fixed rate, or it is possible to reduce the amount supplied of the nitrogen (N)- or oxygen (O)-containing gas from the beginning of forming the charge injection blocking layer 19B gradually at a fixed reduction rate to thereby reduce the amount supplied of the nitrogen (N)- or oxygen (O)-containing gas at a further larger fixed reduction rate. That is, the nitrogen (N) content or the oxygen (O) content has a fixed concentration from the side of the photoconductive layer 19A toward the side of the surface layer 19C and the concentration is suddenly reduced in the vicinity of the surface layer 19C, or the concentration is gradually reduced toward the side of the surface layer 19C at a fixed rate, or the reduction rate has two or more stages so that the concentration is gradually reduced toward the surface layer 19C at a fixed rate and the concentration is gradually reduced at a further larger reduction rate.

As the Group 13 element and the Group 15 element, boron (B) and phosphorous (P) are respectively preferable because covalent binding property is excellent and semiconductor characteristics can be sensitively changed and excellent photosensitivity can be obtained. In the case where the Group 13 element or the Group 15 element is contained in the charge injection blocking layer 19B together with elements such as nitrogen (N) and oxygen (O), the content of the Group 13 element is adjusted to be 0.1 ppm or more and 100000 ppm or less, the content of the Group 15 element is adjusted to be 0.1 ppm or more and 100000 ppm or less, and the nitrogen (N) content or the oxygen (O) content is adjusted to 1 ppm or more and 500000 ppm or less.

The photoconductive layer 19A may contain microcrystalline silicon (pc-Si) in the a-Si based material. When pc-Si is contained, dark conductivity and photoconductivity can be increased, and therefore, there is an advantage that the degree of freedom in design of the photoconductive layer 19A is increased. Such pc-Si can be formed by applying the above-explained film-forming methods and by changing the film-forming conditions. For example, in the glow discharge decomposition method, the temperature of the cylindrical base 18 and the DC pulse power are set to be higher, and the flow rate of hydrogen as a dilution gas is increased to thereby form the film. Also in the photoconductive layer 19A containing pc-Si, elements (Group 13 elements, Group 15 elements, carbon (C), nitrogen (N), oxygen (O), etc.) similar to the above-explained elements can be added.

When the surface layer 19C is formed as the a-SiC based deposited film, a mixed gas including the Si-containing gas such as SiH4 (silane gas) and a C-containing gas such as CH4 is supplied as the source gas. The composition ratio between Si and C in the source gas may be changed continuously or intermittently.

When the surface layer 19C is formed as an a-C layer, coupling energy is smaller in C—O coupling than in Si—O coupling, and therefore, the oxidation of the surface of the surface layer 19C can be suppressed more positively as compared with a case where the surface layer 19C is formed of the a-Si based material. Accordingly, when the surface layer 19C is formed as the a-C layer, the oxidation of the surface of the surface layer 19C is appropriately suppressed due to ozone generated with corona discharge at the time of printing, and therefore, the occurrence of image deletion under the environment of high temperature and high humidity can be suppressed. Here, the occurrence of image deletion is the same meaning as the above-described reduction of image contrast.

On the other hand, the application of the pulse-shaped DC voltage to between the cylindrical electrode 40 and the support base 3 is performed by controlling the DC power supply 34 by the controller 35.

More specifically, the controller 35 supplies a negative pulse-shaped DC potential V1 (refer to FIG. 4) within a range of −3000 V or more and −50 V or less, preferably within a range of −3000 V or more and −500 V or less, to the support base 3 (conductive column 31) in the case where the cylindrical electrode 40 is grounded.

On the other hand, when the cylindrical electrode 40 is connected to a reference electrode (not shown), the pulse-shaped DC potential V1 supplied to the support base (conductive column 31) is set to a range of, for example, 3000 V or more and −50 V or less (target potential difference ΔV) by using a potential V2 supplied from the reference power supply as a reference potential. In addition, the potential V2 supplied from the reference power supply is set to, for example, 1500 V or more and 1500 V or less when the negative pulse-shaped voltage (refer to FIG. 4) is applied to the support base 3 (cylindrical base 18).

The controller 35 controls the DC power supply 34 so that the frequency (1/T (sec)) of the DC voltage is 300 kHz or less and so that the duty ratio (T1/T) is 20% or more and 90% or less.

Figure 4:
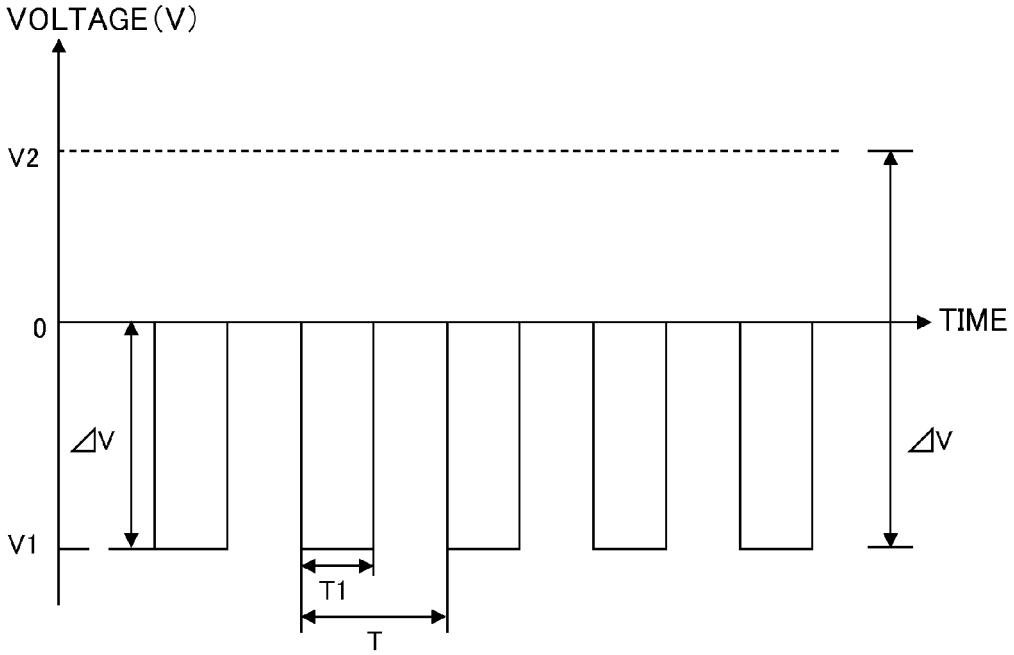
FIG. 4 is a graph for explaining a voltage application state in the plasma CVD apparatus shown in FIG. 3.

The duty ratio in the invention is defined as a proportion of time occupied by an potential difference generation T1 in one cycle (T) of the pulse-shaped DC voltage (a period of time from the moment when the potential difference is generated between the cylindrical base 18 and the cylindrical electrode 40 to the moment when the potential difference is generated again) as shown in FIG. 4. For example, the duty ratio 20% means that the time occupied by the potential difference generation (ON) in one cycle at the time of applying the pulse-shaped voltage is 20% of the entire one cycle.

As the image forming apparatus 1 according to the embodiment has the negatively-charged drum 10, such constitution is preferable from the viewpoint of suppressing the reduction of image quality caused by the residual potential while sufficiently maintaining the image contrast to be formed.

The specific embodiment of the invention has been described as the above, however, the invention is not limited to the above, and various modification is possible without departing from the scope of the invention.

For example, the concentration of carbon (C) contained in the charge injection blocking layer 19B may be higher on the side of the surface layer 19C than on the side of the photosensitive layer 19A. The oxidation of Si included in the charge injection blocking layer 19B can be relatively reduced by applying the above configuration, and therefore, image characteristics can be maintained to be relatively higher while improving the electrostatic property of the photoreceptor drum 10. Additionally, as the carbon (C) content contained in the charge injection blocking layer 19B is increased, the hardness of the charge injection blocking layer 19B can be relatively higher, thereby forming the photoreceptor drum 10 with excellent abrasion resistance.

Additionally, a protective layer formed of a non-single crystalline material mainly containing carbon such as a-C may be provided further on the surface layer 19C. When applying the above configuration, the non-single crystalline material which mainly contains carbon having relatively high hardness is provided as the protective layer, and therefore, the abrasion resistance of the photoreceptor drum 10 can be relatively high. As the non-single crystalline material which mainly contains carbon such as a-C is relatively excellent in moisture resistance, moisture adsorption to the photoreceptor drum 10 can be relatively suppressed, and therefore, the occurrence of image deletion in image characteristics particularly under the environment of high temperature and high humidity can be suppressed.

REFERENCE SIGNS LIST

1: Image forming apparatus
2: Plasma CVD apparatus
3: Support base
4: Reaction chamber
5: Rotation means
6: Gas supply means
7: Exhaust means
10: Negative-charge electrophotographic photoreceptor
11: Charging device
12: Exposure device
13: Developing device
14: Transfer device
15: Fixing device
16: Cleaning device
17: Charge removing device
18: Cylindrical base (Base)
19: Photosensitive layer
19A: Photoconductive layer
19B: Charge injection blocking layer
19C: Surface layer

What is claimed is:

1. An electrophotographic photoreceptor, comprising:
a cylindrical base; and
a photosensitive layer disposed on the cylindrical base, wherein the photosensitive layer comprises a photoconductive layer disposed on the cylindrical base, a charge injection blocking layer disposed on the photoconductive layer, and a surface layer disposed on the charge injection blocking layer,
the charge injection blocking layer contains at least one of nitrogen and oxygen, carbon, and a group 13 element,
a content of the at least one of nitrogen and oxygen contained in the charge injection blocking layer is lower on a side of the surface layer than on a side of the photosensitive layer, and
a content of carbon contained in the charge injection blocking layer is gradually increased from the side of the photosensitive layer toward the side of the surface layer.

2. The electrophotographic photoreceptor according to claim 1, wherein the content of the at least one of nitrogen and oxygen contained in the charge injection blocking layer is gradually reduced from the side of the photosensitive layer toward the side of the surface layer.

3. The electrophotographic photoreceptor according to claim 1, wherein the group 13 element is boron.

4. The electrophotographic photoreceptor according to claim 1, further comprising:
a protective layer disposed on the surface layer.

5. The electrophotographic photoreceptor according to claim 4, wherein the protective layer is formed of a non-single crystalline material mainly containing carbon.

6. An image forming apparatus, comprising:
the electrophotographic photoreceptor according to claim 1;
a driving force transfer section disposed at one end in an axial direction of the electrophotographic photoreceptor, the driving force transfer section transferring a driving force of rotation; and
a charging device disposed along the axial direction of the electrophotographic photoreceptor, the charging device having a charging ability of a same polarity.

* * * * *